US009852701B2

(12) United States Patent
Kurasawa et al.

(10) Patent No.: US 9,852,701 B2
(45) Date of Patent: *Dec. 26, 2017

(54) DISPLAY DEVICE WITH IMPROVED LUMINANCE

(71) Applicant: Japan Display Inc., Tokyo (JP)

(72) Inventors: Hayato Kurasawa, Kanagawa (JP); Yoshihiro Watanabe, Kanagawa (JP)

(73) Assignee: Japan Display Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/083,429

(22) Filed: Mar. 29, 2016

(65) Prior Publication Data

US 2016/0210913 A1 Jul. 21, 2016

Related U.S. Application Data

(63) Continuation of application No. 13/446,198, filed on Apr. 13, 2012, now Pat. No. 9,330,621.

(30) Foreign Application Priority Data

Apr. 21, 2011 (JP) ..... 2011-094626

(51) Int. Cl.

| | |
|---|---|
| ***G09G 5/10*** | (2006.01) |
| ***G09G 3/36*** | (2006.01) |
| ***G09G 3/20*** | (2006.01) |
| ***G09G 3/34*** | (2006.01) |

(52) U.S. Cl.

CPC ..... *G09G 3/3607* (2013.01); *G09G 3/2003* (2013.01); *G09G 3/3413* (2013.01); *G09G 3/3648* (2013.01); *G09G 3/3677* (2013.01); *G09G 3/3696* (2013.01); *G09G 2300/0452* (2013.01); *G09G 2300/0456* (2013.01); *G09G 2310/0202* (2013.01); *G09G 2310/027* (2013.01); *G09G 2320/0242* (2013.01); *G09G 2320/0626* (2013.01); *G09G 2320/0666* (2013.01); *G09G 2360/144* (2013.01); *G09G 2360/16* (2013.01)

(58) Field of Classification Search

USPC ..... 345/690, 207, 102

See application file for complete search history.

(56) References Cited

U.S. PATENT DOCUMENTS

| | | | |
|---|---|---|---|
| H1506 | H | 12/1995 | Beretta |
| 6,870,323 | B1 | 3/2005 | Cok |
| 7,256,855 | B2 | 8/2007 | Baek |

(Continued)

FOREIGN PATENT DOCUMENTS

| | | | |
|---|---|---|---|
| JP | 10-239681 | A | 9/1998 |
| JP | 3167026 | B2 | 3/2001 |

(Continued)

OTHER PUBLICATIONS

U.S. Appl. No. 13/446,198, filed Apr. 13, 2012, Kurasawa et al.

*Primary Examiner* — Kwang-Su Yang

(74) *Attorney, Agent, or Firm* — Wolf, Greenfield & Sacks, P.C.

(57) ABSTRACT

A display device is provided. The display device includes a display unit having pixels arranged in a two-dimensional matrix, each pixel including additive mixture subpixels and a luminance adjustment subpixel, and a signal control unit controlling a luminance at a maximum gray scale in the luminance adjustment subpixel depending on an external light illuminance.

14 Claims, 8 Drawing Sheets

(56) References Cited

U.S. PATENT DOCUMENTS

| | | | |
|---|---|---|---|
| 7,495,722 | B2 | 2/2009 | Roth et al. |
| 7,499,128 | B2 | 3/2009 | Hu et al. |
| 2005/0237450 | A1 | 10/2005 | Hu et al. |
| 2006/0164408 | A1 | 7/2006 | Nishikawa et al. |
| 2008/0049005 | A1 | 2/2008 | Okita et al. |
| 2008/0084524 | A1 | 4/2008 | Inuzuka et al. |
| 2008/0186263 | A1 | 8/2008 | Lee |
| 2009/0128752 | A1 | 5/2009 | Itou et al. |
| 2010/0033456 | A1 | 2/2010 | Yoshida et al. |
| 2011/0234646 | A1 | 9/2011 | Han et al. |
| 2011/0279029 | A1 | 11/2011 | Hirakata et al. |
| 2012/0268502 | A1 | 10/2012 | Kurasawa et al. |

FOREIGN PATENT DOCUMENTS

| | | | |
|---|---|---|---|
| JP | 2007-510936 | A | 4/2007 |
| JP | 2008-083483 | A | 4/2008 |
| JP | 2008-176115 | A | 7/2008 |
| JP | 2009-237013 | A | 10/2009 |
| JP | 2011-186191 | A | 9/2011 |
| WO | WO 2008/139766 | A1 | 11/2008 |
| WO | WO 2010/046643 | A2 | 4/2010 |

DISPLAY DEVICE WITH IMPROVED LUMINANCE

CROSS REFERENCE TO RELATED APPLICATIONS

This application is a continuation of U.S. application Ser. No. 13/446,198, entitled "Display Device with Improved Luminance" and filed on Apr. 13, 2012, which claims priority to Japanese Patent Application No. 2011-094626, filed in the Japanese Patent Office on Apr. 21, 2011, each of which are hereby incorporated herein by reference in their entireties.

BACKGROUND

The present disclosure relates to a display device.

Reflective display devices that display an image by controlling reflectivity of external light, and transmissive display devices that display an image by controlling transmissivity of light from a backlight disposed on the back side thereof have been provided. Further, display devices having the advantages of both of the reflective display devices and the transmissive display devices, for example, transflective display devices having pixels including a reflective region and a transmissive region have been proposed.

In display devices such as color liquid crystal display devices, a color reproduction range has been expanded and luminance has been increased, and therefore devices having display pixels each including a group of subpixels for displaying three primary colors and a subpixel for displaying a different color (white, cyan, or the like) have been proposed.

For example, a color image display device disclosed in Japanese Patent No. 3167026 includes means for generating signals of three colors in an additive three primary colors process from an input signal, and means for generating an auxiliary signal by adding the color signals of the three hues at the same ratio, and supplying signals of the total four colors of the auxiliary signal and the three color signals obtained by subtracting the auxiliary signal from the signals of the three hues to a display device. The three color signals drive a red display subpixel, a green display subpixel, and a blue display subpixel, respectively. The auxiliary signal drives a white display subpixel.

SUMMARY

For example, in a case of a color-display reflective display device, when external light illuminance decreases, the luminance of a displayed image also decreases. In such a case, from a viewpoint of visibility of the image, it is preferable to display the image with saturation being suppressed to a low value, and luminance is increased to a high value. On the other hand, if the external light illuminance is sufficiently high, an adequate luminance of the displayed image can be obtained, and consequently, it is preferable to display the image of high luminance and high saturation. Accordingly, display devices that can adjust the relationship between the saturation and the luminance depending on the external light illuminance and can display an image having good visibility have been desired.

It is desirable to provide a display device that can adjust the relationship between the saturation and the luminance depending on the external light illuminance and can display an image having good visibility.

A display device according to an embodiment of the present disclosure includes a display unit having pixels arranged in a two-dimensional matrix, each pixel including additive mixture subpixels and a luminance adjustment subpixel, and a signal control unit controlling a luminance at a maximum gray scale in the luminance adjustment subpixel depending on an external light illuminance.

A display device according to an embodiment of the present disclosure includes a signal control unit that controls a luminance at a maximum gray scale in the luminance adjustment subpixel depending on an external illuminance. Accordingly, the display device can adjust the relationship between the saturation and the luminance depending on the external illuminance and can display an image having good visibility.

DETAILED DESCRIPTION OF EMBODIMENTS

Figure 1:
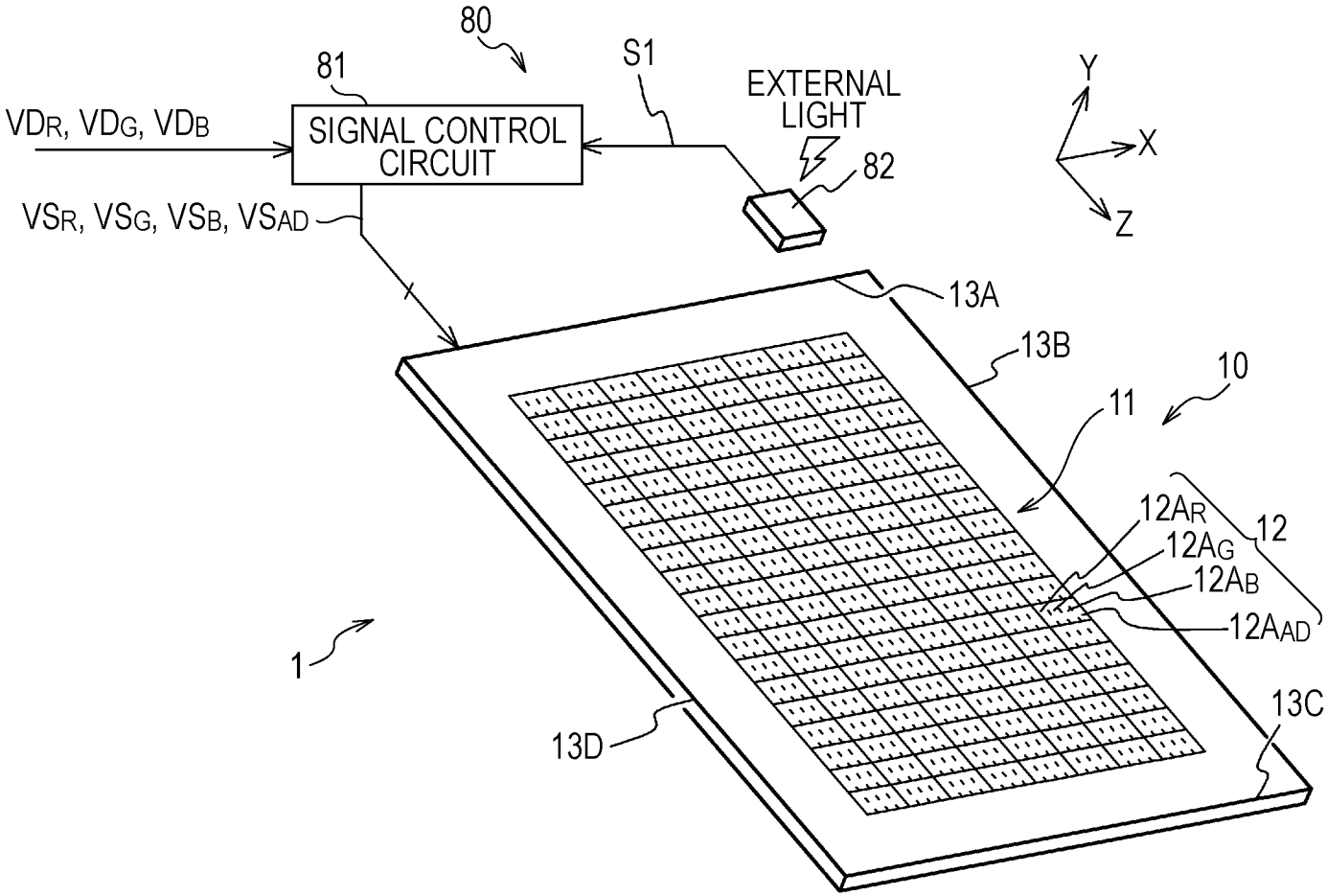
FIG. 1 is a schematic perspective view illustrating a display device according to a first embodiment.

Hereinafter, with reference to the drawings, embodiments of the present disclosure are described. The scope of the present disclosure is not limited to the embodiments, and various numeric values and materials in the embodiments are only examples. In the description below, to the same elements and elements having similar functions, the same reference numerals are applied, and overlapping descriptions are omitted. The description will be made in the following order.

1. Overall description of a display device according to the embodiments of the present disclosure
2. First embodiment
3. Second embodiment and others Overall Description of a Display Device According to the Embodiments of the Present Disclosure A display device according to the embodiments of the present disclosure may include a reflective display unit, a transmissive display unit, or a transflective display unit that has the features of the reflective display unit and the transmissive display. These display units include a display panel such as a liquid crystal display panel. Alternatively, the display units include a self-emitting display device. The self-emitting display device includes an electroluminescence display panel, a plasma display panel, and the like.

A signal control unit for controlling luminance at a maximum gray scale in a luminance adjustment subpixel depending on an external light illuminance includes, for example, a photo sensor for measuring an intensity of external light, and a signal control circuit that controls the value of a voltage for regulating the luminance at the maximum gray scale using an output from the photo sensor. The photo sensor includes existing sensors such as a photodiode and a phototransistor. The signal control circuit includes existing circuits such as an operational circuit, a digital-analog (D/A) converter, a voltage generation circuit, and the like. Such circuits include existing circuit elements.

As described above, a reflective, transmissive, or transflective display unit can be used. A display device employing the reflective type or the transflective type can display an image of good visibility depending on external light illuminance.

In the display device according to the embodiments of the present disclosure, a pixel includes subpixels for additive color mixture. Generally, color displaying is performed using an additive color mixture process of different three primary colors. For example, a pixel includes a first subpixel for displaying a first primary color (for example, red), a second subpixel for displaying a second primary color (for example, green), and a third subpixel for displaying a third primary color (for example, blue). However, the number of the subpixels for additive color mixture included in the pixel is not limited to three. For example, the pixel may include a fourth subpixel for displaying a fourth primary color for extending the color reproduction range. In addition to the subpixels, the pixel can further include a fifth subpixel for displaying a fifth primary color. In another example, in a configuration using an additive color mixture process of a color gamut of two colors to be displayed, a pixel may include two subpixels for additive color mixture. Generally, the term "primary color" means a color that is not obtained by mixing other colors. In the embodiments of the present disclosure, the definition of the term is not limited to the above-described definition.

In the display device according to the embodiments of the present disclosure including the above-described preferred configurations, the display device may be controlled such that the luminance at the maximum gray scale in the luminance adjustment subpixel is lowered as external light illuminance increases. For example, in a case where the external light illuminance is lower than a first reference value, the luminance at the maximum gray scale in the luminance adjustment subpixel may be set to a maximum value in the design. In another example, in a case where the external light illuminance is higher than a second reference value (the second reference value>the first reference value), the luminance at the maximum gray scale in the luminance adjustment subpixel may be set to a minimum value in the design.

In the display apparatus according to the embodiments of the present disclosure including the above-described various preferred configurations, the gray scale of the luminance adjustment subpixel may be controlled using a signal indicating luminance information of the additive mixture subpixel. For example, in a case where the additive mixture subpixel includes a first subpixel, a second subpixel, and a third subpixel, the gray scale may be controlled using a signal indicating luminance information generated using each of three kinds of signals corresponding to the individual subpixels. In such a case, the signal indicating the luminance information may be a signal indicating a Y stimulus value. The Y stimulus value is a luminance value in the XYZ color system defined by the Commission internationale de l'éclairage (CIE), or the like. For example, the Y stimulus value may be calculated by adding a predetermined coefficient to each of values of R, G, and B of a reference stimulus in a color equation and adding the values.

In the display apparatus according to the embodiments of the present disclosure including the above-described preferred various configurations, the luminance adjustment subpixel may display a color having a saturation lower than those of the colors displayed by the additive mixture subpixels. In such a case, the luminance adjustment subpixel may display white.

In another example, in the display apparatus according to the embodiments of the present disclosure including the above-described preferred configurations, the luminance adjustment subpixel may display a color different from those displayed by the additive mixture subpixels. In such a case, the luminance adjustment subpixel may display yellow or cyan.

In the individual embodiments described below, a color liquid crystal display panel of an active matrix type is used for the display unit.

The liquid crystal panel includes, for example, a front panel having a transparent common electrode, a rear panel having a pixel electrode, and a liquid crystal material disposed between the front panel and the rear panel. In the transmissive type, the pixel electrode is composed of a transparent conductive material. In the reflective type, the pixel electrode may be composed of a material that reflects light, or a reflector independent from the pixel electrode is provided, and the pixel electrode may be composed of a transparent conductive material. The transflective type liquid crystal panel may be similarly composed.

The operation mode of the liquid crystal display panel is not limited to a specific mode. For example, the liquid crystal display panel may be driven in a twisted nematic (TN) mode, a vertical alignment (VA) mode, or an in-plane switching (IPS) mode. Further, the liquid crystal display panel may be a normally white type or a normally black type.

More specifically, the front panel includes, for example, a substrate composed of glass, a transparent common electrode (for example, composed of indium tin oxide (ITO)) provided on the inner surface of the substrate, and a polarizing film provided on the outer surface of the substrate. On the inner surface of the substrate, a color filter covered with an overcoat layer composed of an acrylic resin or an epoxy resin is provided. On the front panel, further, on the overcoat layer, a transparent common electrode is formed. If necessary, an alignment layer may be formed on the transparent common electrode.

The rear panel includes, for example, a substrate composed of glass, a switching element formed on the inner surface of the substrate, and a pixel electrode (for example, composed of ITO) whose conduction of electricity is controlled by the switching element. If necessary, on the whole area including the pixel electrode, an alignment layer may be formed, and a polarizing film or an optical compensation film may be provided on the outer surface of the substrate.

The members and materials constituting the liquid crystal display panel include existing members and materials. For the switching element, for example, a three-terminal element such as a thin-film transistor (TFT), or a two-terminal element such as a metal-insulator-metal (MIM) element, a varistor element, or a diode may be employed. To such a switching element, for example, a scanning line extending in the row direction or a signal line extending in the column direction is connected.

The shape of the display unit is not limited to a specific shape. For example, the display unit may be a landscape-oriented rectangular shape or a portrait-oriented rectangular shape. If the number of M×N pixels in the display unit is expressed as (M, N), for example, in a case where the display unit has a landscape-oriented rectangular shape, for example, the value (M, N) may be a resolution for image display such as (640, 480), (800, 600), (1024, 768) or the like. In a case where the display unit has a portrait-oriented rectangular shape, for example, the value (M, N) may be a resolution obtained by interchanging the values of the above-mentioned resolutions. The values are not limited to the examples.

When an illumination unit for illuminating the display unit with light is to be used, an existing illumination unit may be employed. The configuration of the illumination unit is not limited to a specific configuration. Generally, the illumination unit includes existing members such as a light source and a light guide plate.

The various conditions described in the embodiments of the present disclosure may be strictly satisfied or substantially satisfied. For example, a color "red" means a color that is recognized substantially as red, and a color "green" means a color that is recognized substantially as green. Similar descriptions can be applied to "blue", "white", "yellow" and "cyan". Further, variations due to the design or the manufacturing process are allowed.

First Embodiment

A display device according to the first embodiment of the present disclosure is described.

FIG. 1 is a schematic perspective view illustrating the display device according to the first embodiment.

A display device 1 includes a display unit 10 having pixels 12 arranged in a two-dimensional matrix, each pixel 12 including additive mixture subpixels $\mathbf{12}A_R$, $\mathbf{12}A_G$, and $\mathbf{12}A_B$ and a luminance adjustment subpixel $\mathbf{12}A_{AD}$. The display unit 10 is a reflective display unit. More specifically, the display unit 10 includes a reflective color liquid crystal display panel.

The display device 1 further includes a signal control unit 80 that controls a luminance at a maximum gray scale in the luminance adjustment subpixel $\mathbf{12}A_{AD}$ depending on an external light illuminance. The signal control unit 80 includes a photo sensor 82 and a signal control circuit 81. The photo sensor 82 detects an intensity (illuminance) of external light (environmental light). The signal control circuit 81 performs control using an output from the photo sensor 82 or the like. The photo sensor 82 includes, for example, a photodiode. Due to photovoltaic effect, a photo sensor output (voltage) of the photo sensor 82 changes depending on the intensity of the external light. The photo sensor 82 is disposed at a place where the photo sensor 82 can receive the external light, and is not affected by light from an image displayed on the display unit 10. In FIG. 1, a scanning circuit 101 illustrated in FIG. 2 described below is omitted.

The additive mixture subpixels $\mathbf{12}A_R$, $\mathbf{12}A_G$, and $\mathbf{12}A_B$ may be referred to as a first subpixel $\mathbf{12}A_R$, a second subpixel $\mathbf{12}A_G$, and a third subpixel $\mathbf{12}A_B$ respectively. The first subpixel $\mathbf{12}A_R$ displays red as a first primary color. The second subpixel $\mathbf{12}A_G$ displays green as a second primary color. The third subpixel $\mathbf{12}A_B$ displays blue as a third primary color. The luminance adjustment subpixel $\mathbf{12}A_{AD}$ displays a color having a saturation lower than those of the colors displayed by the additive mixture subpixels. Specifically, the luminance adjustment subpixel $\mathbf{12}A_{AD}$ displays white.

Based on the operation of the signal control unit 80, the luminance at the maximum gray scale in the luminance adjustment subpixel $\mathbf{12}A_{AD}$ is controlled depending on the external light illuminance. More specifically, the luminance at the maximum gray scale in the luminance adjustment subpixel $\mathbf{12}A_{AD}$ is controlled such that the luminance decreases as the external light illuminance increases. The gray scale of the luminance adjustment subpixel $\mathbf{12}A_{AD}$ is controlled based on a signal indicating luminance information of the additive mixture subpixels $\mathbf{12}A_R$, $\mathbf{12}A_G$, and $\mathbf{12}A_B$. More specifically, the signal indicating the luminance information is a signal indicating a Y stimulus value. The configuration and operation of the signal control unit 80 are described in detail below with reference to FIGS. 5, 6A and 6B described below.

In the description below, the additive mixture subpixels and the luminance adjustment subpixel may be simply referred to as "subpixels $\mathbf{12}A_R$, $\mathbf{12}A_G$, $\mathbf{12}A_B$, and $\mathbf{12}A_{AD}$" without limiting the types of the subpixels.

In the description, it is assumed that a display region 11 of the display unit 10 is in parallel with the X-Z plane, and the direction in which images are to be observed is the +Y direction. As illustrated in the drawing, the display unit 10 includes a front panel in the +Y direction, a rear panel in the −Y direction, a liquid crystal material disposed between the front panel and the rear panel, and the like. For the purpose of illustration, in FIG. 1, the display unit 10 is illustrated as one panel. The display unit 10 has a rectangular shape, and the display region 11 where the pixels 12 are arranged also has a rectangular shape. Reference numerals 13A, 13B, 13C, and 13D indicate sides of the display unit 10. In a display unit according to another embodiment illustrated in FIG. 7 described below, the reference numerals similarly indicate sides of the display unit.

In the display region 11, the total of M×N pixels 12, i.e., M pixels in the row direction (X direction in the drawing), and N pixels in the column direction (Z direction in the drawing) are arranged. The pixel 12 of the m-th column (m=1, 2, . . . , M), and the n-th row (n=1, 2, . . . , N) is referred to as the (m, n)th pixel 12, or the pixel $\mathbf{12}_{(m,\ n)}$. The number of pixels (M, N) in the display unit 10 is, for example, (768, 1024). To display units in the other embodiments, this description is similarly applied.

In the first embodiment, the pixel 12 includes a group of the reflective subpixels $\mathbf{12}A_R$, $\mathbf{12}A_G$, $\mathbf{12}A_B$, and $\mathbf{12}A_{AD}$. First, the display unit 10 is described in detail. Then, the configuration and operation of the signal control unit 80 are described in detail.

Figure 2:
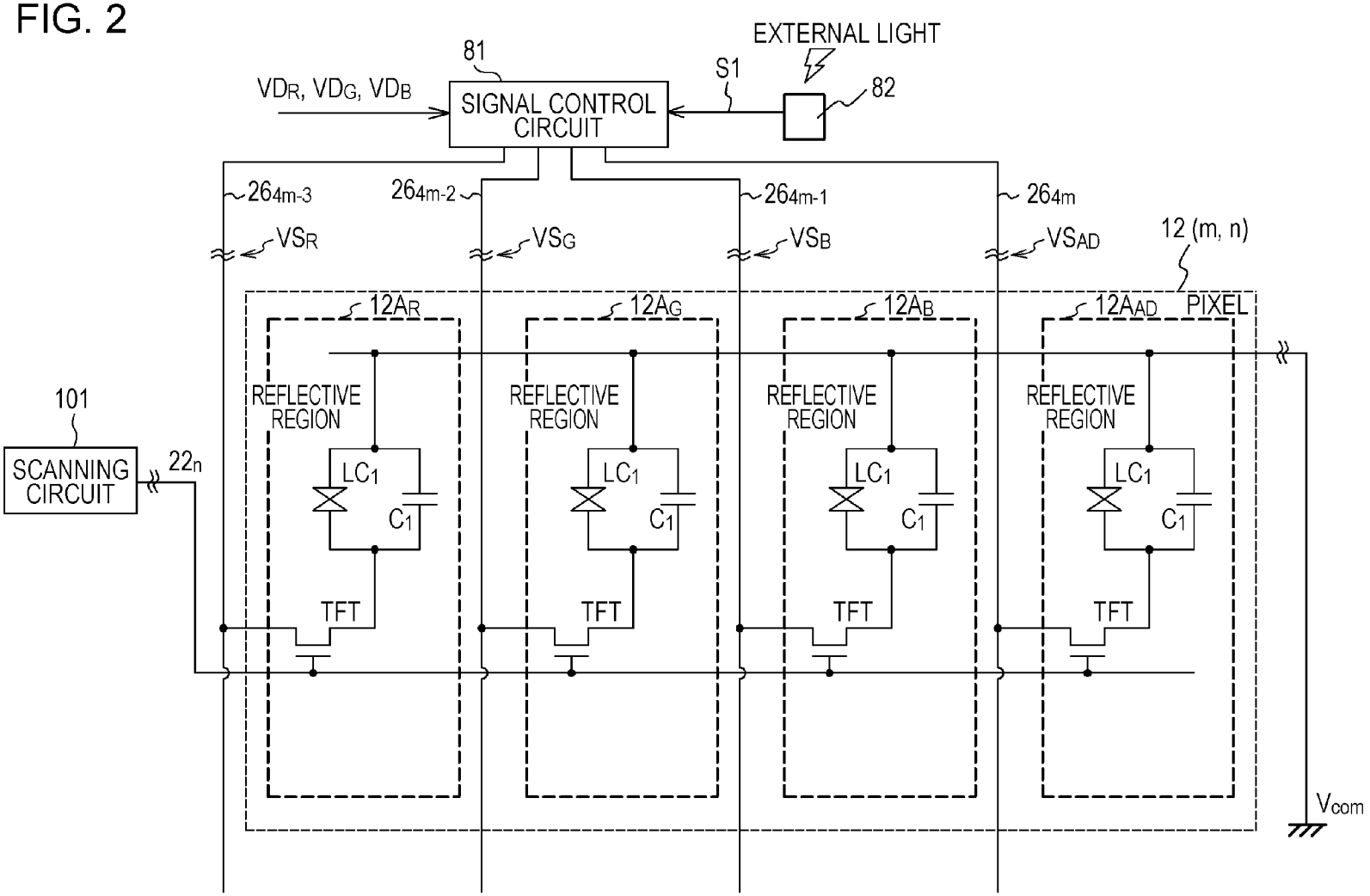
FIG. 2 is a schematic circuit diagram illustrating a part of a display unit, the part including an (m, n)th pixel.

FIG. 2 is a schematic circuit diagram illustrating a part of the display unit 10, the part including the (m, n)th pixel.

The display device 1 includes the reflective subpixels $12A_R$, $12A_G$, $12A_B$, and $12A_{AD}$ having N scanning lines 22 each extending in the row direction and one end is being connected to a scanning circuit 101, 4×M signal lines 26 each extending in the column direction and one end is being connected to the signal control circuit 81, and transistors (TFTs) being connected to the scanning lines 22 and the signal lines 26 and operating in response to a scanning signal from the scanning lines 22.

To the pixel $12_{(m,n)}$, the scanning line 22 (hereinafter, may be referred to as a scanning line $22_n$) of the n-th row is connected. To the subpixel $12A_R$, the signal line 26 of the (4×m−3)th column is connected. To the subpixel $12A_G$, the signal line 26 of the (4×m−2)th column is connected. To the subpixel $12A_B$, the signal line 26 of the (4×m−1)th column is connected. To the subpixel $12A_{AD}$, the signal line 26 of the (4×m)th column is connected. In the drawings and description below, the indication of "×" may be omitted. For example, the signal line 26 of the (4×m)th column may be expressed as $26_{4m}$.

Figure 3:
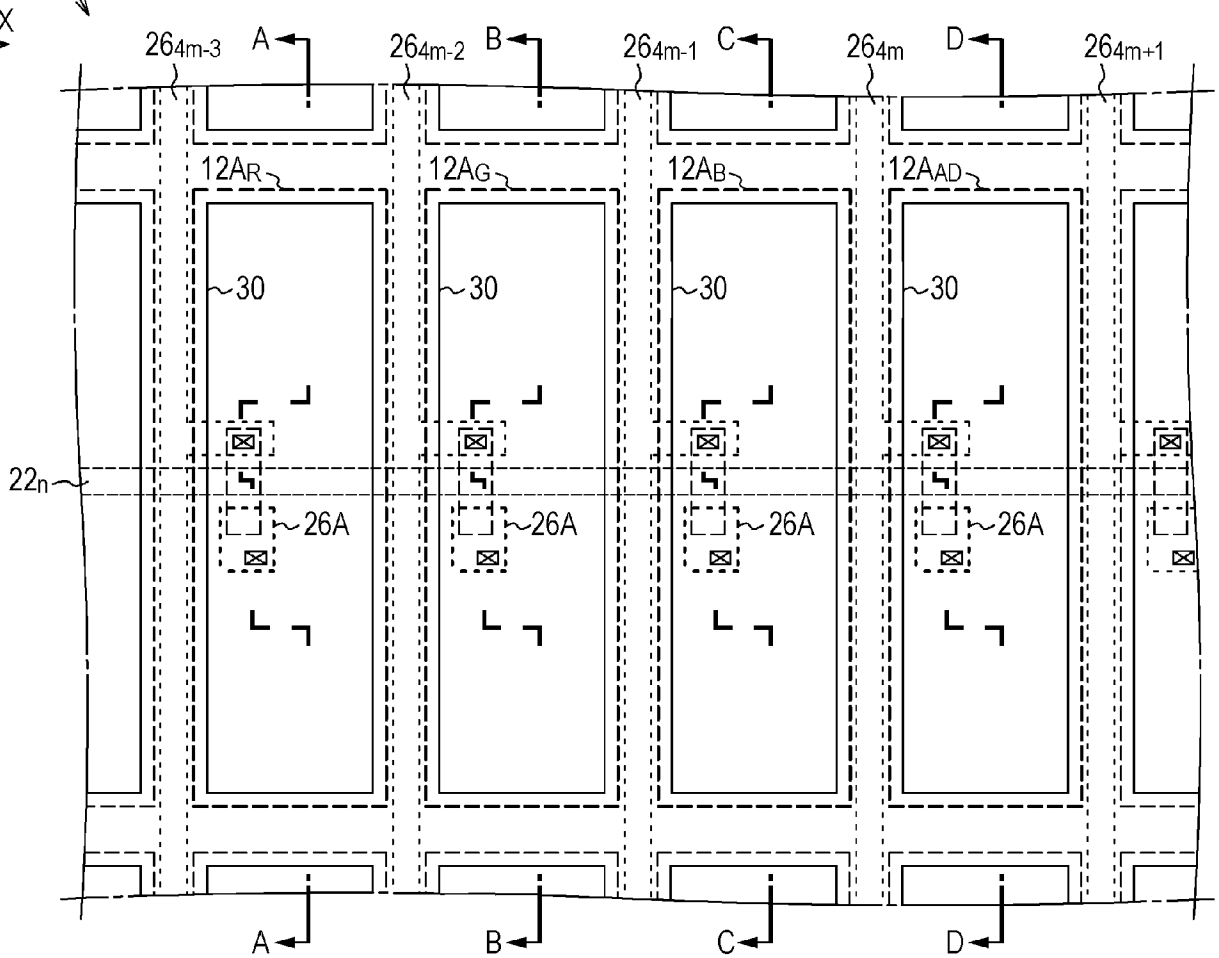
FIG. 3 is a schematic plan view illustrating a layout of various elements in the part including the (m, n)th pixel of the display unit.
Figure 4:
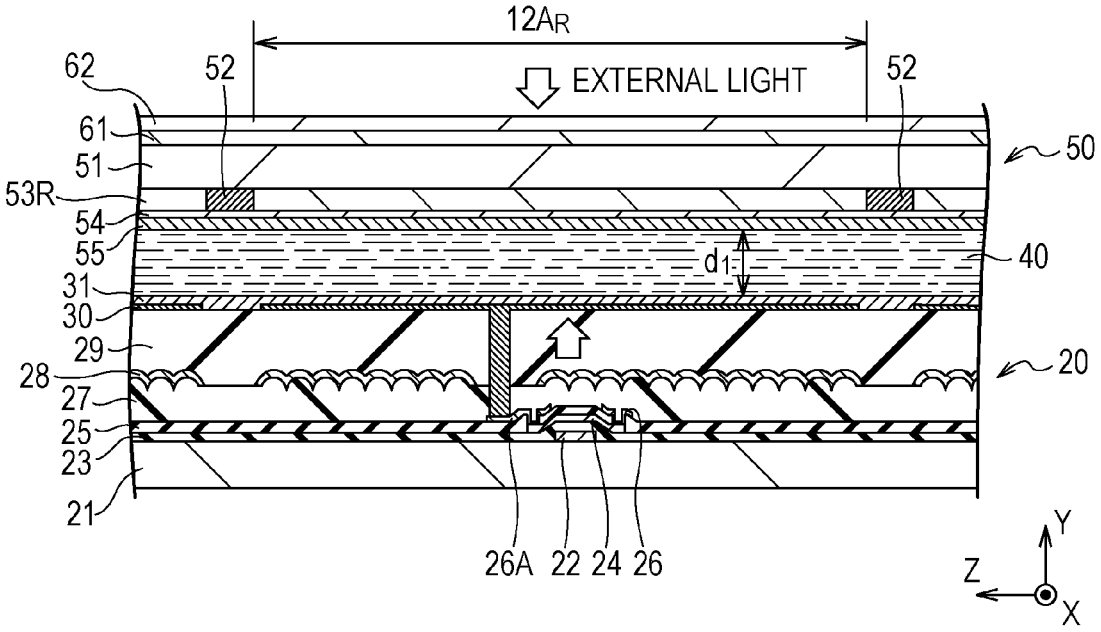
FIG. 4 is a schematic cross-sectional view of the display unit taken along the line A-A in FIG. 3.

The liquid crystal capacitor $LC_1$ illustrated in FIG. 2 includes a transparent common electrode provided on the front panel, a pixel electrode provided on the rear panel, and a liquid crystal material layer sandwiched between the front panel and the rear panel. The storage capacitor $C_1$ includes an auxiliary electrode conducted to the pixel electrode and the like. In FIGS. 3 and 4 described below, the auxiliary electrode is omitted.

Input signals $VD_R$, $VD_G$, and $VD_B$ corresponding to a color image to be displayed are externally supplied to the display device 1. The input signals $VD_R$, $VD_G$, and $VD_B$ are a signal for displaying red, a signal for displaying green, and a signal for displaying blue, respectively. According to the operation of the signal control circuit 81, video signals $VS_R$, $VS_G$, $VS_B$, and $VS_{AD}$ for driving the subpixels $12A_R$, $12A_G$, $12A_B$, and $12A_{AD}$ are generated from the input signals $VD_R$, $VD_G$, and $VD_B$. The relationship between the input signals $VD_R$, $VD_G$, and $VD_B$ and the video signals $VS_R$, $VS_G$, $VS_B$, and $VS_{AD}$ is described in detail below with reference to FIG. 5. The video signal $VS_R$ drives the subpixel $12A_R$. The video signal $VS_G$ drives the subpixel $12A_G$. The video signal $VS_B$ drives the subpixel $12A_B$. The video signal $VS_{AD}$ drives the subpixel $12A_{AD}$.

In the description below, the input signals may be simply referred to as "input signals VD" without limiting the types of the input signals. Similarly, in the description below, the video signals may be simply referred to as "video signals VS" without limiting the types of the video signals.

FIG. 3 is a schematic plan view illustrating a layout of the various components in the part including the (m, n)th pixel of the display unit 10. FIG. 4 is a schematic cross-sectional view of the display unit taken along the line A-A in FIG. 3.

As illustrated in FIG. 4, the display unit 10 includes a rear panel 20, a front panel 50, and a liquid crystal material layer 40 sandwiched between the panels.

The front panel 50 includes, a substrate 51, a transparent common electrode 54, a quarter wavelength plate 61, and a polarizing film 62. The substrate 51 is, for example, composed of glass. The transparent common electrode 54 is, for example, composed of ITO, and provided on the inner surface of the substrate 51. The quarter wavelength plate 61 is provided on the outer surface of the substrate 51. The polarizing film 62 covers the quarter wavelength plate 61. This structure is similar to those in the other embodiment described below.

On the liquid crystal material layer 40 side of the substrate 51, black matrixes 52, a color filter, the transparent common electrode 54, and an upper alignment layer 55 are provided. The black matrixes 52 are disposed at corresponding positions between adjacent subpixels. The color filter is disposed within the region surrounded by the black matrixes 52. The transparent common electrode 54 covers the whole surface including the black matrixes 52 and the color filter. The upper alignment layer 55 covers the whole surface including the transparent common electrode 54. In FIG. 4, reference numeral $53_R$ denotes a red color filter.

If FIG. 4 is a schematic cross-sectional view illustrating the display unit taken along the line B-B in FIG. 3, reference numeral $12A_R$ is replaced with reference numeral $12A_G$, and the red color filter $53_R$ is replaced with a green color filter $53_G$. Similarly, if FIG. 4 is a schematic cross-sectional view illustrating the display unit taken along the line C-C in FIG. 3, reference numeral $12A_R$ is replaced with reference numeral $12A_B$, and the red color filter $53_R$ is replaced with a blue color filter $53_B$. Similarly, if FIG. 4 is a schematic cross-sectional view illustrating the display unit taken along the line D-D in FIG. 3, reference numeral $12A_R$ is replaced with reference numeral $12A_{AD}$, and the red color filter $53_R$ is replaced with a white color filter (that is, simply, a transparent filter) $53_{AD}$.

The rear panel 20 includes, a substrate 21, a switching element, and a pixel electrode. The substrate 21 is, for example, composed of glass. The switching element is composed of a TFT, and the element is formed on the inner surface of the substrate 21. The pixel electrode is, for example, composed of ITO, and the conduction of the electrode is controlled by the switching element.

More specifically, at the liquid crystal material layer 40 side of the substrate 21, a first insulating layer 23 and a second insulating layer 25 are formed in a stacked structure. Between the substrate 21 and the first insulating layer 23, the scanning line 22 is formed. Between the first insulating layer 23 and the second insulating layer 25, a semiconductor thin layer 24 that forms the TFT is formed. On the second insulating layer 25, the signal line 26 is formed. To one source-drain electrode of the TFT, a tongue region of the signal line 26 is connected. To the other source-drain electrode, through a conduction part 26A, a pixel electrode 30 is connected. The conduction part 26A is, for example, formed by patterning simultaneously with the formation of the signal line 26.

The TFT functions as the switching element that operates according to a signal from the scanning line 22. In response to the operation of the TFT according to the scanning signal from the scanning line 22, from the signal control circuit 81 through the signal line 26, the video signals $VS_R$, $VS_G$, $VS_B$, and $VS_{AD}$ are applied to the pixel electrode 30.

On the second insulating layer 25, a first insulating interlayer 27 is formed. On the front surface of the first insulating interlayer 27, at parts corresponding to the subpixels, projections and depressions are formed. On the projections and depressions, for example, a reflector 28 is formed, for example, by evaporating aluminum. On the reflector 28, a second insulating interlayer 29 is formed. On the second insulating interlayer 29, the pixel electrode 30 is formed. Further, a lower alignment layer 31 that covers the whole surface including the pixel electrode 30 is provided.

As illustrated in FIG. 3, the pixel electrode 30 is formed in a rectangular shape. As illustrated in FIGS. 3 and 4, the pixel electrode 30 is connected to the conduction part 26A through the contact penetrating the insulating interlayers 29 and 27.

The liquid crystal material layer 40 is in contact with the lower alignment layer 31 and the upper alignment layer 55.

The alignment layers 31 and 55 define the direction of the molecular axis of liquid crystal molecules in a state in which an electric field is not applied.

A voltage $V_{com}$ (for example, 0 V) illustrated in FIG. 2 is applied to the transparent common electrode 54 illustrated in FIG. 4. Accordingly, the intensity of the magnetic field generated between the pixel electrode 30 and the transparent common electrode 54 can be controlled by a voltage (that is, the video signals VS) applied to the pixel electrode 30. Further, the electric field generated between the pixel electrode 30 and the transparent common electrode 54 controls the alignment state of the liquid crystal molecules composing the liquid crystal material layer 40.

In FIG. 4, the thickness of the liquid crystal material layer 40 is denoted by reference numeral $d_1$ and held at a predetermined value by a spacer, or the like (not illustrated). The liquid crystal material layer 40 functions as a quarter wavelength plate when no voltage is applied. As the absolute value of the applied voltage increases, the function as the quarter wavelength plate decreases. When the absolute value of the applied voltage is a certain large value, the liquid crystal material layer 40 simply functions as a transparent layer.

External light passes through the polarizing film 62, turns into linearly polarized light, and enters the quarter wavelength plate 61. Then, in a state the phase is shifted by a quarter wavelength, the light enters the liquid crystal material layer 40.

When no voltage is applied to the liquid crystal material layer 40, entered light is transmitted through the liquid crystal material layer 40 and the phase of the light further shifts by a quarter wavelength. In this state, the light reaches the reflector 28 and is reflected. The phase of the reflected light further shifts by a quarter wavelength when the light is transmitted through the liquid crystal material layer 40. In this state, the light enters the quarter wavelength plate 61. The total of the phase differences of the light that is transmitted through the quarter wavelength plate 61 and enters the polarizing film 62 is one wavelength. This means no phase difference exists. Consequently, the light is directly transmitted through the polarizing film 62, and exits toward the observer side in a state in which the luminance of the subpixel is high.

On the other hand, when a voltage of an adequate value is applied and the liquid crystal material layer 40 simply functions as a transparent layer, the phase of the light being transmitted through the liquid crystal material layer 40 does not change. As described above, the external light passes through the polarizing film 62, turns into the linearly polarized light, and enters the quarter wavelength plate 61. Then, in the state in which the phase is shifted by the quarter wavelength, the light enters the liquid crystal material layer 40. When the light reflected by the reflector 28 enters the quarter wavelength plate 61 again, the phase shift remains by the quarter wavelength. Consequently, the total of the phase differences of the light that is transmitted through the quarter wavelength plate 61 and enters the polarizing film 62 is half the wavelength. This means that the light is linearly polarized light rotated by 90 degrees, and consequently, the polarization direction of the light is perpendicular to the polarizing axis of the polarizing film 62. As a result, the light is not emitted toward the observer side, and the luminance of the subpixel is low.

As described above, the luminance (in other words, the reflectivity of the external light) of the subpixel increases as the absolute value of the voltage applied to the liquid crystal material layer 40 decreases. That is, the display unit 10 operates as a normally white display unit. Meanwhile, a display unit that operates as a normally black display unit can be employed. In such a case, the display unit is to be controlled such that the relationship between the applied voltage and the luminance becomes opposite.

The configuration and operation of the signal control unit 80 are described in detail.

Figure 5:
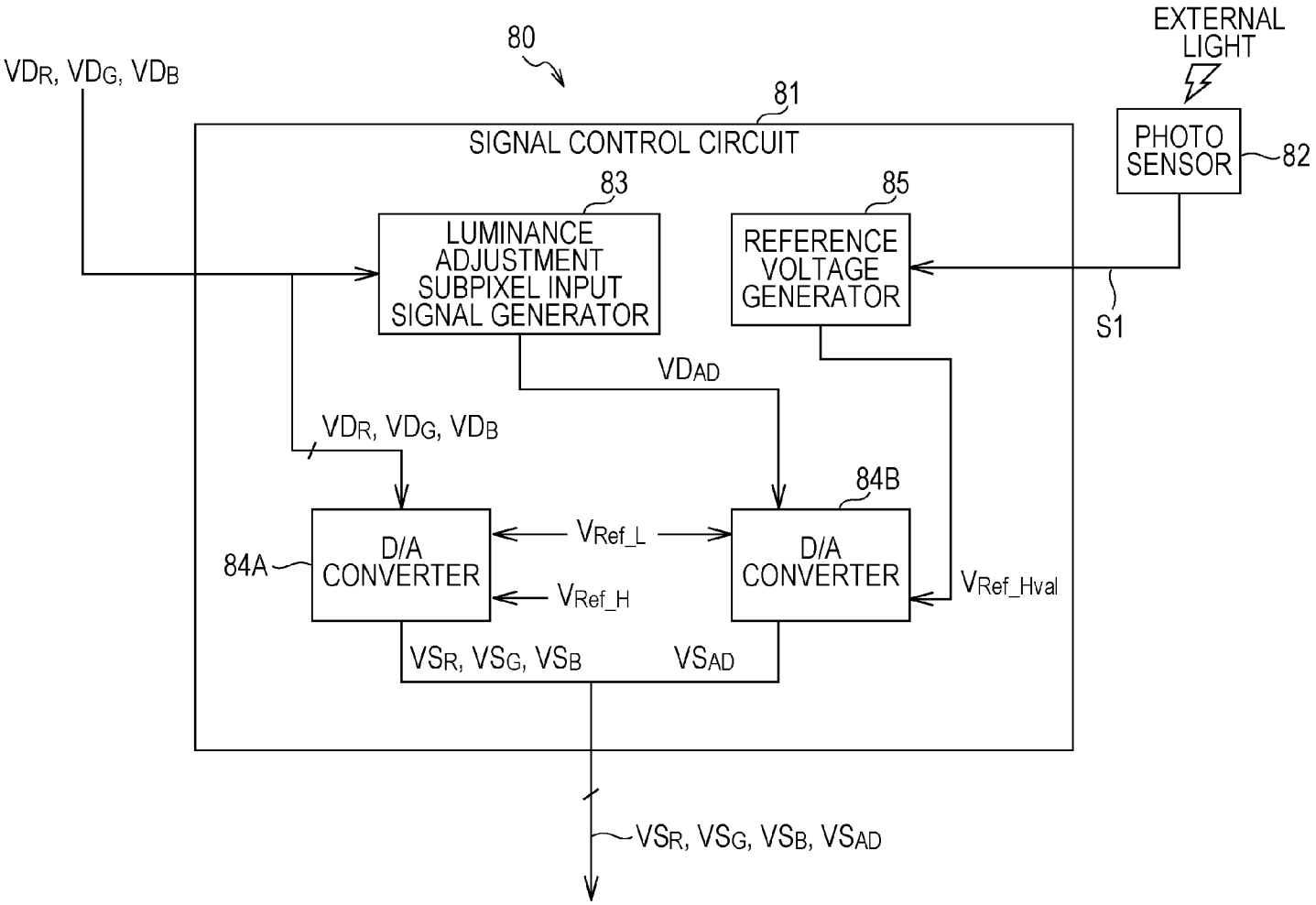
FIG. 5 is a schematic block diagram illustrating a signal control unit.

FIG. 5 is a schematic block diagram illustrating the signal control unit 80.

As described above, the signal control unit 80 includes the photo sensor 82 and the signal control circuit 81. The photo sensor 82 detects an intensity of external light. The signal control circuit 81 performs control using an output S1 or the like from the photo sensor 82.

The signal control circuit 81 includes a luminance adjustment subpixel input signal generator 83, D/A converters 84A and 84B, and a reference voltage generator 85. These elements include a logic circuit, an operational circuit, and the like, and can include an existing circuit element. Each part constituting the signal control circuit 81 and the operational timing of the scanning circuit 101 illustrated in FIG. 2 are controlled by a timing controller (not illustrated).

The luminance adjustment subpixel input signal generator 83 generates the input signal $VD_{AD}$ corresponding to the luminance adjustment subpixel $\mathbf{12}A_{AD}$ using the input signals $VD_R$, $VD_G$, and $VD_B$ that are externally inputted corresponding to the color image to be displayed. The gray scale of the luminance adjustment subpixel $\mathbf{12}A_{AD}$ is controlled by the signal $VD_{AD}$ generated using the three signals $VD_R$, $VD_G$, and $VD_B$ that correspond to the additive mixture subpixels $\mathbf{12}A_R$, $\mathbf{12}A_G$, and $\mathbf{12}A_B$ respectively. More specifically, the signal $VD_{AD}$ generated using the three signals $VD_R$, $VD_G$, and $VD_B$ indicates a Y stimulus value.

In the description, it is assumed that the input signals $VD_R$, $VD_G$, and $VD_B$ are discrete gray scale values of 0 to 255 in 8 bits, respectively. The values are not limited to the discrete values in 8 bits, but can be appropriately selected depending on the design or the like of the display device.

The input signals $VD_R$, $VD_G$, and $VD_B$ are inputted to the luminance adjustment subpixel input signal generator 83. The luminance adjustment subpixel input signal generator 83 calculates a Y stimulus value shown in the following equation (1) using the input signal $VD_R$ for a stimulus value R, the input signal $VD_G$ for a stimulus value G, and the input signal $VD_B$ for a stimulus value B. The values of coefficients shown in the equation (1) are an example in a case of a standard RGB (sRGB) color space, and the values are not limited to the example.

$$\begin{bmatrix} X \\ Y \\ Z \end{bmatrix} = \begin{bmatrix} 0.412424 & 0.357579 & 0.180464 \\ 0.212656 & 0.715158 & 0.072186 \\ 0.019332 & 0.119193 & 0.950444 \end{bmatrix} \begin{bmatrix} R \\ G \\ B \end{bmatrix} \quad (1)$$

As described above, the Y stimulus value means a luminance value in the XYZ color system defined by the CIE, or the like. The Y stimulus value is zero when all of the input signals $VD_R$, $VD_G$, and $VD_B$ are at zero gray scale, and the Y stimulus value is 255 when all of the input signals $VD_R$, $VD_G$, and $VD_B$ are at 255 gray scale. The luminance adjustment subpixel input signal generator 83 outputs the Y stimulus value as the input signal $VD_{AD}$ for the luminance adjustment subpixel. Similarly to the input signals $VD_R$, $VD_G$, and $VD_B$, the input signal $VD_{AD}$ is a value at a gray scale from 0 to 255.

Now, the video signals $VS_R$, $VS_G$, $VS_B$, and $VS_{AD}$ are described.

The input signals $VD_R$, $VD_G$, and $VD_B$ are inputted to the D/A converter 84A. The D/A converter 84A outputs the video signals $VS_R$, $VS_G$, and $VS_B$ that are voltage signals corresponding to the gray scale values of the input signals $VD_R$, $VD_G$, and $VD_B$.

To the D/A converter 84A, voltages $V_{REF_H}$ and $V_{REF_L}$ are applied as reference voltages for performing the D/A conversion. The voltage $V_{REF_H}$ defines the voltage at the maximum gray scale (255 level), and the value is, for example, about 0 V. The voltage $V_{REF_L}$ defines the voltage at the minimum gray scale (0 level), and the value is, for example, about 4 V.

Practically, in order to operate the liquid crystal material layer 40 in alternating current driving, the polarity of, for example, the voltage $V_{REF_L}$ is switched, for example, for each display frame. In the description, the voltage polarity reversal is not taken into consideration.

The video signals VS outputted by the D/A converter 84A take values closer to the voltage $V_{REF_H}$ as the gray scale values of the input signals VD become closer to 255. On the other hand, the video signals VS take values closer to the voltage $V_{REF_L}$ as the gray scale values of the input signals VD become closer to zero.

To the D/A converter 84B, the above-mentioned input signal $VD_{AD}$ is inputted. The D/A converter 84B outputs the video signal $VS_{AD}$ that is the voltage signal corresponding to the gray scale value of the input signal $VD_{AD}$. The D/A converter 84B controls the luminance at the maximum gray scale of the luminance adjustment subpixel $\mathbf{12}A_{AD}$ depending on the external light illuminance. Consequently, in the D/A converter 84B, the control corresponding to the external light illuminance is performed.

To the D/A converter 84B, the above-described voltage $V_{REF_L}$ and a voltage $V_{REF_Hval}$ from the reference voltage generator 85 are applied.

To the reference voltage generator 85, from the photo sensor 82, the photo sensor output S1 corresponding to the external light illuminance is inputted. In the description, it is assumed that the value of the photo sensor output S1 increases depending on the external light illuminance, for example, when the external light illuminance is $1\times10^2$ lux, the value reaches a first reference value $L_1$, and when the external light illuminance is $1\times10^4$ lux, the value reaches a second reference value $L_2$.

If the photo sensor output S1 is lower than or equal to the first reference value $L_1$, the reference voltage generator 85 sets the value of the voltage $V_{REF_Hval}$ to about 0 V similarly to the voltage $V_{REF_H}$, and if the photo sensor output S1 is higher than the second reference value $L_2$, the reference voltage generator 85 sets the value of the voltage $V_{REF_Hval}$ to about 4 V similarly to the voltage $V_{REF_L}$.

If the photo sensor output S1 is higher than the first reference value $L_1$ and lower than or equal to the second reference voltage $L_2$, the reference voltage generator 85 increases the value of the voltage $V_{REF_Hval}$ depending on the value of the photo sensor output S1. In such a case, the value of the voltage $V_{REF_Hval}$ takes a value between the voltage $V_{REF_H}$ and the voltage $V_{REF_L}$ depending on the external light illuminance.

The operation of the D/A converter 84B is similar to that in the D/A converter 84A, except that the value of the voltage $V_{REF_Hval}$ is controlled depending on the external light illuminance. The voltage value of the video signal $VS_{AD}$ outputted by the D/A converter 84B takes a value closer to the voltage $V_{REF_Hval}$ as the gray scale value of the input signal $VD_{AD}$ becomes closer to 255. On the other hand, the voltage value of the video signal $VS_{AD}$ takes a value closer to the voltage $V_{REF_L}$ as the gray scale value of the input signal $VD_{AD}$ becomes closer to zero.

In the D/A converter 84B, as described above, the value of the voltage $V_{REF_Hval}$ defining the voltage at the maximum gray scale (255 level) is controlled depending on the external light illuminance. By the control, the luminance at the maximum gray scale of the luminance adjustment subpixel $\mathbf{12}A_{AD}$ is controlled depending on the external light illuminance.

That is, in a case where the external light illuminance is lower than or equal to $1\times10^2$ lux, the voltage $V_{REF_Hval}$ takes a value similar to the voltage $V_{REF_H}$. Consequently, the subpixels $\mathbf{12}A_R$, $\mathbf{12}A_G$, $\mathbf{12}A_B$, and $\mathbf{12}A_{AD}$ are driven in the same condition, and as a result, no difference is generated in the reflectivities of the external light at the maximum gray scale value. Accordingly, basically, the luminances of the individual subpixels at the maximum gray scale take similar values.

In a case where the external light illuminance is higher than $1\times10_2$ lux and lower than or equal to $1\times10_4$ lux, the voltage $V_{REF_Hval}$ takes a value between the voltage $V_{REF_H}$ and the voltage $V_{REF_L}$. Consequently, as the external light illuminance increases, the luminance of the luminance adjustment subpixel $\mathbf{12}A_{AD}$ at the maximum gray scale decreases.

In a case where the external light illuminance is higher than $1\times10_4$ lux, the voltage $V_{REF_Hval}$ takes a value similar to the voltage $V_{REF_L}$ that defines the minimum gray scale (0 level). Consequently, the luminance adjustment subpixel $\mathbf{12}A_{AD}$ is driven in a condition different from those for the subpixels $\mathbf{12}A_R$, $\mathbf{12}A_G$, and $\mathbf{12}A_B$. The reflectivity of the external light in the luminance adjustment subpixel $\mathbf{12}A_{AD}$ at the maximum gray scale is substantially zero, and accordingly, the luminance adjustment subpixel $\mathbf{12}A_{AD}$ is in a substantially black display state irrespective of the gray scale value.

As described above, based on the operation of the signal control unit 80, the luminance at the maximum gray scale in the luminance adjustment subpixel $\mathbf{12}A_{AD}$ is controlled depending on the external light illuminance. More specifically, the luminance at the maximum gray scale in the luminance adjustment subpixel $\mathbf{12}A_{AD}$ is controlled such that the luminance decreases as the external light illuminance increases. The control of the luminance is described with reference to FIGS. 6A, 6B, and 7.

Figure 6A:
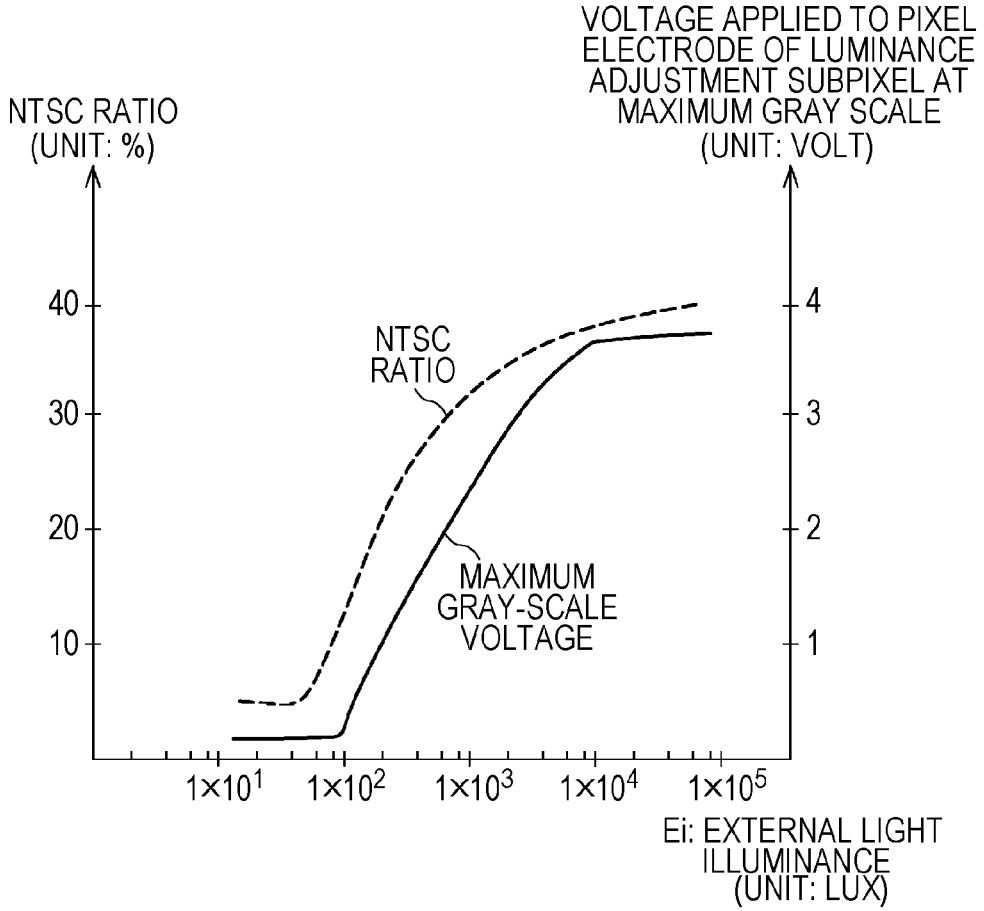
FIG. 6A is a schematic graph illustrating a relationship between a voltage applied to a pixel electrode of a luminance adjustment subpixel at a maximum gray scale and an external light illuminance, and a relationship between an NTSC ratio and an external light illuminance in a color gamut of the display unit.
Figure 6B:
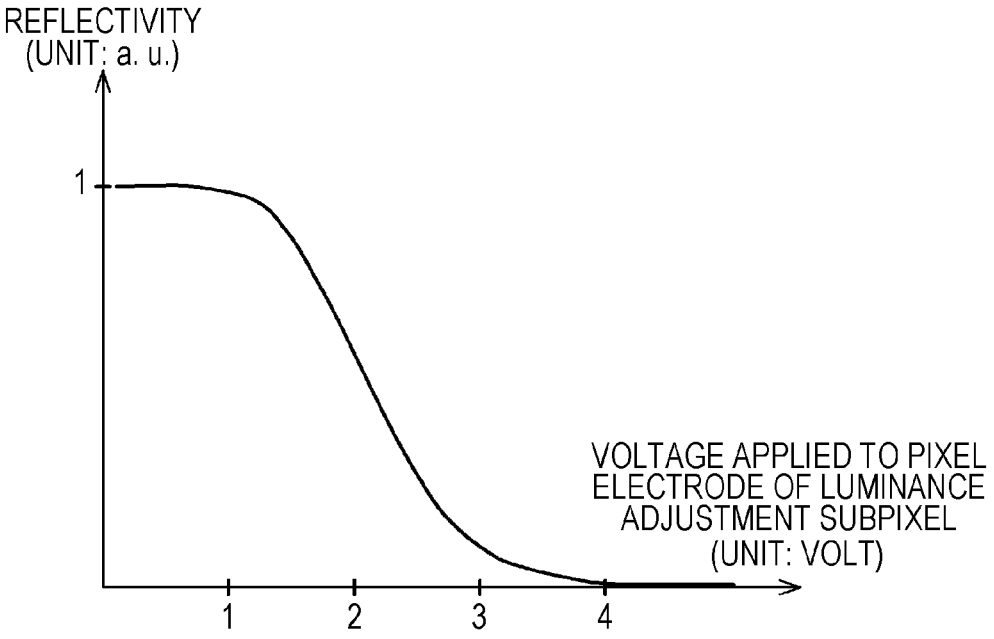
FIG. 6B is a schematic graph illustrating a relationship between a voltage applied to a pixel electrode of a luminance adjustment subpixel and an external light reflectivity.

FIG. 6A is a schematic graph illustrating the relationship between the voltage applied to the pixel electrode of the luminance adjustment subpixel at the maximum gray scale and the value of the external illuminance, and the relationship between an NTSC ratio and the value of the external illuminance in the color gamut of the display unit. FIG. 6B is a schematic graph illustrating the relationship between the voltage applied to the pixel electrode of the luminance adjustment subpixel and the external light reflectivity.

As illustrated in FIG. 6A, as the external light illuminance Ei increases, the voltage applied to the pixel electrode 30 in the luminance adjustment subpixel $\mathbf{12}A_{AD}$ at the maximum gray scale increases. As illustrated in FIG. 6B, as the voltage applied to the pixel electrode 30 in the luminance adjustment subpixel $\mathbf{12}A_{AD}$ increases, the external light reflectivity decreases. In FIG. 6B, the unit of the vertical axis is an arbitrary unit normalized by the maximum reflectivity equal to one.

Qualitatively, if display using a luminance adjustment subpixel having a high lightness and a low saturation such as white is performed, the luminance of the displayed image increases and the saturation of the image decreases. Consequently, an NTSC ratio (a ratio to a region in a triangle color gamut in the NTSC system in the 1976 UCS chromaticity) varies depending on the voltage applied to the pixel electrode 30 in the luminance adjustment subpixel $\mathbf{12}A_{AD}$ at the maximum gray scale. In the first embodiment, the NTSC ratio is about 40% when the external light illuminance exceeds $1\times10^4$ lux, and as the external light illuminance decreases, the NTSC ratio decreases. When the external light illuminance is lower than or equal to $1\times10^2$ lux, the NTSC ratio decreases to about 5%.

As a result, in a bright place, the image having the high luminance and the high saturation can be displayed. On the other hand, in a dark place, the image having the low saturation but having the higher luminance can be displayed. As described above, depending on the external light illuminance, the relationship between the saturation and the luminance can be adjusted, and the image having excellent visibility can be displayed.

Second Embodiment

The second embodiment is a modification of the first embodiment. In the second embodiment, as compared to the first embodiment, the color displayed by the luminance adjustment subpixel differs, and setting of the areas of the subpixels differs.

In a schematic perspective view illustrating a display device according to the second embodiment, the display unit 10 illustrated in FIG. 1 is replaced with a display unit 210, and the display device 1 is replaced with a display device 2. In a schematic circuit diagram illustrating a part of the display unit 210, the part including the (m, n)th pixel, is similar to the circuit diagram illustrated in FIG. 2.

As described above, a pixel includes, as the additive mixture subpixels, the first subpixel $\mathbf{12}A_R$ that displays red as the first primary color, the second subpixel $\mathbf{12}A_G$ that displays green as the second primary color, and the third subpixel $\mathbf{12}A_B$ that displays blue as the third primary color. The luminance adjustment subpixel $\mathbf{12}A_{AD}$ displays a color different from the color displayed by the additive mixture subpixels. More specifically, the luminance adjustment subpixel $\mathbf{12}A_{AD}$ displays yellow. Alternatively, the luminance adjustment subpixel $\mathbf{12}A_{AD}$ can display cyan.

Figure 7:
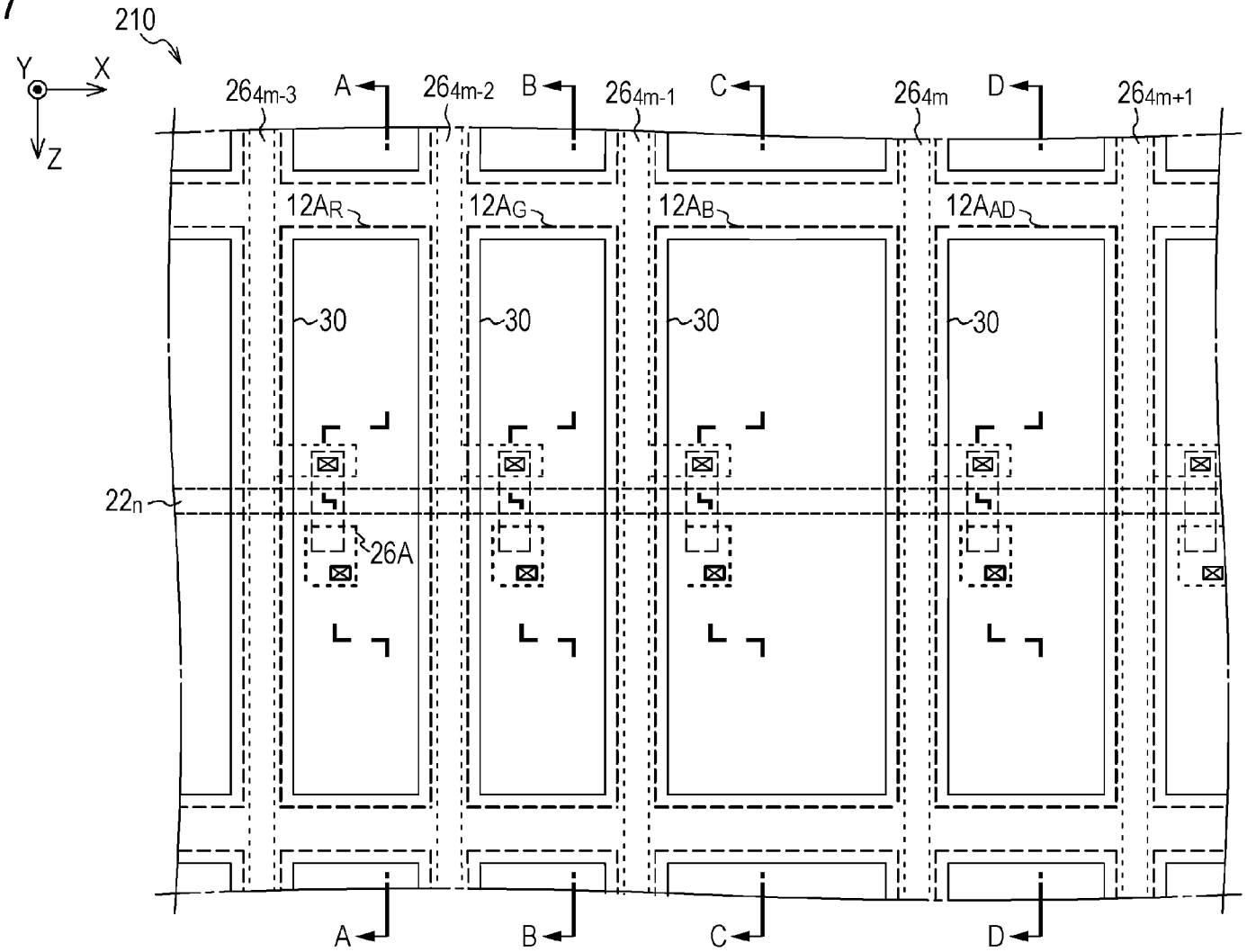
FIG. 7 is a schematic plan view illustrating a layout of elements in the part including the (m, n)th pixel of a display unit in a display device according to a second embodiment.

FIG. 7 is a schematic plan view illustrating a layout of the various components of a part in the display unit in the display device according to the second embodiment, the part including the (m, n)th pixel.

In the second embodiment, the luminance adjustment subpixel $\mathbf{12}A_{AD}$ displays yellow. Consequently, qualitatively, when the luminance adjustment subpixel $\mathbf{12}A_{AD}$ operates, the color of the image shifts to the yellow side. Accordingly, the display by the additive mixture subpixels is set to shift to the blue side where the relationship of complementary colors is established. More specifically, as illustrated in FIG. 7, the size of the third subpixel $\mathbf{12}A_B$ that displays blue is set to a size larger than those of the first subpixel $\mathbf{12}A_R$ and the second subpixel $\mathbf{12}A_G$. The ratio of the size of each subpixel to the entire pixel size can be appropriately set depending on the design of the display device.

A schematic cross-sectional view of the display unit taken along the line A-A in FIG. 7 is similar to the cross-sectional view illustrated in FIG. 4. Similarly to the description in the first embodiment, the line B-B and the line C-C in FIG. 7 are to be appropriately replaced with the cross-sectional view illustrated in FIG. 4. In a schematic cross-sectional view illustrating the display unit taken along the line D-D in FIG. 7, reference numeral $\mathbf{12}A_R$ in FIG. 4 is replaced with reference numeral $\mathbf{12}A_{AD}$, and the red color filter $\mathbf{53}_R$ in FIG. 4 is replaced with a yellow color filter $\mathbf{53}_{AD}$.

The operation of the signal control unit 80 is similar to that described in the first embodiment. The yellow luminance adjustment subpixel $\mathbf{12}A_{AD}$ is, similarly to that in the first embodiment, driven by the input signal $VD_{AD}$ for the luminance adjustment subpixel.

Figure 8A:
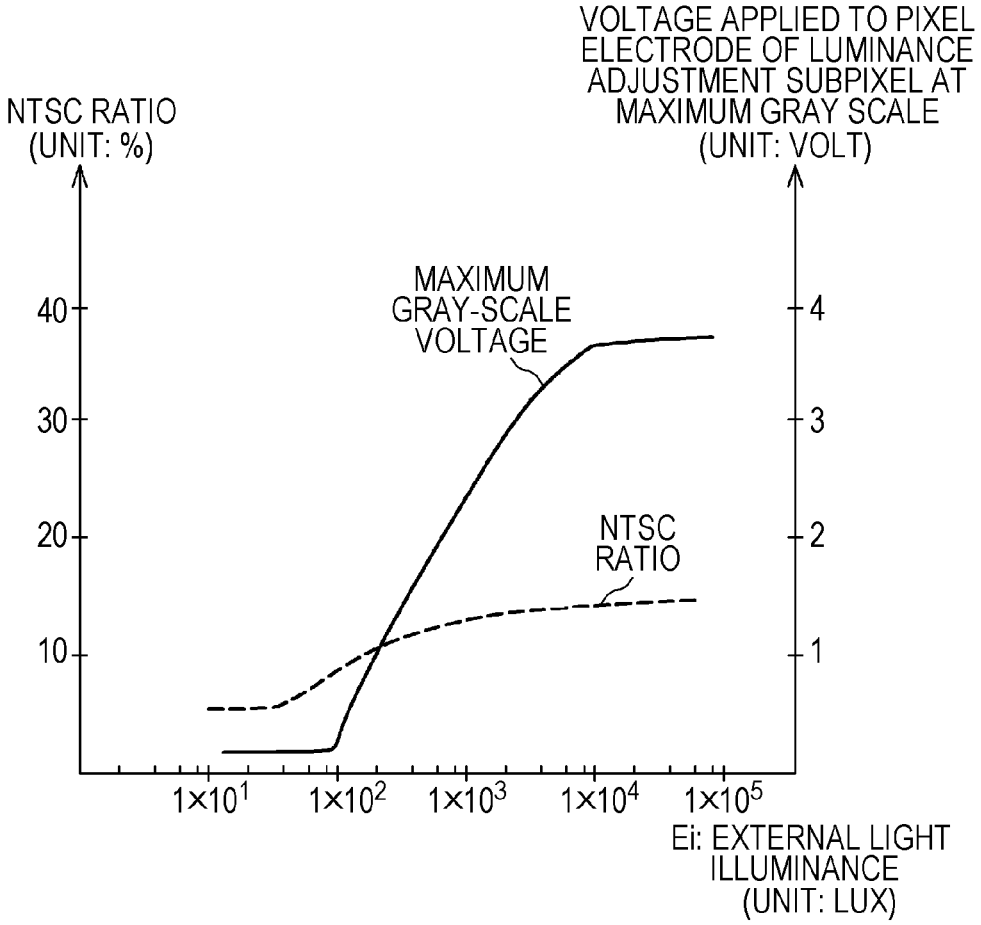
FIG. 8A is a schematic graph illustrating a relationship between a voltage applied to a pixel electrode of a luminance adjustment subpixel at a maximum gray scale and an external light illuminance, and a relationship between an NTSC ratio and an external light illuminance in a color gamut of the display unit.
Figure 8B:
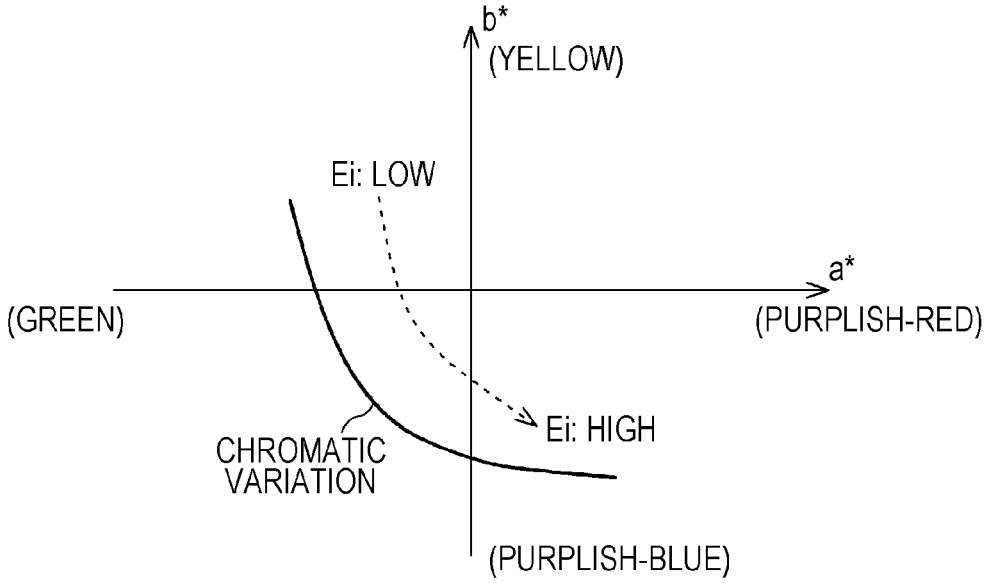
FIG. 8B is a schematic graph illustrating a color variation when external light illuminance changed.

FIG. 8A is a schematic graph illustrating the relationship between the voltage applied to the pixel electrode of the luminance adjustment subpixel at the maximum gray scale and the value of the external illuminance, and the relationship between an NTSC ratio and the value of the external illuminance in the color gamut of the display unit. FIG. 8B is a schematic graph illustrating a color variation when the external light illuminance changed.

In the second embodiment, the NTSC ratio is about 15% when the external light illuminance exceeds $1\times10^4$ lux, and as the external light illuminance decreases, the NTSC ratio decreases. When the external light illuminance is lower than or equal to $1\times10^2$ lux, the NTSC ratio decreases to about 5%.

As described above, similarly to the description in the first embodiment, in a bright place, the image having the high luminance and the high saturation can be displayed. On the other hand, in a dark place, the image having the low saturation but having the higher luminance can be displayed. As described above, depending on the external light illuminance, the relationship between the saturation and the luminance can be adjusted, and the image having excellent visibility can be displayed.

In the second embodiment, as the external light illuminance increases, the hue in the white display varies in the blue direction. FIG. 8B illustrates the relationship between the external light illuminance and the variation in the chromaticity coordinates in a L*a*b* color system. As illustrated in the graph in FIG. 8B, as the external light illuminance Ei increases, the color coordinates vary in the +a* direction and in the −b* direction.

Generally, reflective liquid crystal display panels tend to have a yellowish tint in the white display due to the constituent materials. Such a tendency can be corrected by adjusting a spectral transmittance in a color filter. However, the correction may cause decrease in the efficiency in the use of the light. According to the second embodiment, when the external light illuminance is high, the hue in the white display shifts in the blue direction. Consequently, there is an advantage that the yellowish tint in the white display becomes less noticeable.

While the present disclosure has been specifically described with reference to the embodiments, it is to be understood that the present disclosure is not limited to the disclosed embodiments, and various modifications and changes can be made within the technical scope of the disclosure.

For example, in the above-described embodiments, a transflective display unit may be employed as the display unit. When the transflective display unit is employed, for example, each subpixel may include a reflective region and a transmissive region. For example, the transmissive region can be formed by removing a part of the second insulating interlayer 29 and the reflector 28 illustrated in FIG. 4, and making the thickness of the liquid crystal material layer 40 in the part function as a half-wavelength plate. On the outside (backlight side) of the rear panel, in addition to the polarizing film, a necessary optical compensation film may be provided.

Further, the present technology may be provided as follows:

(1) A display device including:

a display unit having pixels arranged in a two-dimensional matrix, each pixel including additive mixture subpixels and a luminance adjustment subpixel; and a signal control unit controlling a luminance at a maximum gray scale in the luminance adjustment subpixel depending on an external light illuminance.

(2) The display device described in (1), wherein the display unit is a reflective or transflective display unit.

(3) The display device described in (1) or (2), wherein the luminance at the maximum gray scale in the luminance adjustment subpixel is controlled to decrease as the external light illuminance increases.

(4) The display device described in any one of (1) to (3), wherein the gray scale of the luminance adjustment subpixel is controlled using a signal indicating luminance information of the additive mixture subpixels.

(5) The display device described in (4), wherein the signal indicating the luminance information indicates a Y stimulus value.

(6) The display device described in any one of (1) to (5), wherein the luminance adjustment subpixel displays a color having a saturation lower than those of colors displayed by the additive mixture subpixels.

(7) The display device described in (6), wherein the luminance adjustment subpixel displays white.

(8) The display device described in (1), wherein the luminance adjustment subpixel displays a color different from those displayed by the additive mixture subpixels.

(9) The display device described in (8), wherein the luminance adjustment subpixel displays yellow or cyan.

The present disclosure contains subject matter related to that disclosed in Japanese Priority Patent Application JP 2011-094626 filed in the Japan Patent Office on Apr. 21, 2011, the entire contents of which are hereby incorporated by reference.

What is claimed is:

1. A display device comprising:

a display unit having pixels arranged in a two-dimensional matrix, each pixel including additive mixture subpixels and a luminance adjustment subpixel; and a signal control unit configured to control a luminance at a maximum gray scale in the luminance adjustment subpixel, the signal control unit including:

a photo sensor configured to produce a photo output based on an external light illuminance, and a signal control circuit comprising:

a first converting circuit configured to generate video signals for driving the additive mixture subpixels, the video signals being set corresponding to gray scales of input signals; and a second converting circuit configured to generate an adjustment pixel video signal for driving the luminance adjustment subpixel, the adjustment pixel video signal being generated according to the photo output from the photo sensor, wherein only the luminance at the maximum gray scale in the luminance adjustment subpixel is controlled depending on the external light illuminance, and wherein the signal control unit is configured to control the luminance in the luminance adjustment subpixel independently of the additive mixture subpixels.

2. The display device according to claim 1, wherein the display unit is a reflective or transflective display unit.

3. The display device according to claim 1, wherein the luminance at the maximum gray scale in the luminance adjustment subpixel is controlled to decrease as the external light illuminance increases.

4. The display device according to claim 1, wherein the gray scale of the luminance adjustment subpixel is controlled using a signal indicating luminance information of the additive mixture subpixels.

5. The display device according to claim 4, wherein the signal indicating the luminance information indicates a Y stimulus value.

6. The display device according to claim 1, wherein the luminance adjustment subpixel displays a color having a saturation lower than saturations of colors displayed by the additive mixture subpixels.

7. The display device according to claim 6, wherein the luminance adjustment subpixel displays white.

8. The display device according to claim 1, wherein the luminance adjustment subpixel displays a color different from colors displayed by the additive mixture subpixels.

9. The display device according to claim 8, wherein the luminance adjustment subpixel displays yellow or cyan.

10. The display device according to claim 9, wherein the additive mixture subpixels include a first subpixel, a second subpixel, and a third subpixel, and the third subpixel that displays blue has a size larger than each of the first subpixel and the second subpixel.

11. The display device according to claim 1, wherein a voltage applied to a pixel electrode of the luminance adjustment subpixel at the maximum gray scale increases as the external light illuminance increases.

12. The display device according to claim 1, wherein predetermined reference voltages include:

a high scale voltage that is a reference voltage applied to the first converting circuit at the maximum gray scale, and a low scale voltage that is a reference voltage applied to the first converting circuit at the minimum gray scale, and wherein the video signals are set corresponding to gray scales of input signals and based on the predetermined reference voltages.

13. The display device according to claim 12, wherein the first converting circuit is to configured to:

output the video signals to have values closer to the high scale voltage as the gray scale values of the input signals become closer to the maximum gray scale, and output the video signals to have values closer to the low scale voltage as the gray scale values of the input signals become closer to zero.

14. The display device according to claim 12, wherein the signal control circuit is configured to:

set an external-light reference voltage to the high scale voltage when a value of the photo output is equal to or less than a first level, set an external-light reference voltage between the high scale voltage and the low scale voltage when the value of the photo output is between the first level and a second level higher than the first level, and set an external-light reference voltage to the low scale voltage when the value of the photo output is equal to or greater than the second level, wherein the adjustment pixel video signal is generated according to the external light reference voltage.

* * * * *